US005915589A

United States Patent [19]

Lim

[11] Patent Number: 5,915,589

[45] Date of Patent: Jun. 29, 1999

[54] PROGRAMMABLE AUTOMATIC PILL DISPENSER WITH PAWL INDEXING MECHANISM

[76] Inventor: James Lim, 299 Somerset Rd, Oakland, Calif. 94611

[21] Appl. No.: 08/720,749

[22] Filed: Oct. 1, 1996

[51] Int. Cl.[6] ..... G07F 11/00

[52] U.S. Cl. ..... 221/3; 221/13; 221/15

[58] Field of Search ..... 221/2, 3, 7, 15, 221/13, 9, 82, 86, 120, 133, 30; 364/479.14, 479.01, 479.03

[56] References Cited

U.S. PATENT DOCUMENTS

| | | | |
|---|---|---|---|
| 3,815,780 | 6/1974 | Bauer | 221/15 |
| 3,863,439 | 2/1975 | Bauer | 221/15 |
| 4,047,635 | 9/1977 | Bennett, Jr. | 221/5 |
| 4,117,952 | 10/1978 | Grimes | 221/5 |
| 4,207,992 | 6/1980 | Brown | 221/15 |
| 4,223,801 | 9/1980 | Carlson | 221/3 |
| 4,572,403 | 2/1986 | Benaroya | 221/3 |
| 4,573,606 | 3/1986 | Lewis et al. | 221/2 |
| 4,674,651 | 6/1987 | Scidmore et al. | 221/3 |
| 4,763,810 | 8/1988 | Christiansen | 221/3 |
| 4,798,309 | 1/1989 | Stone et al. | 221/4 |
| 4,809,877 | 3/1989 | Albright | 221/75 |
| 4,811,764 | 3/1989 | McLaughlin | 141/98 |
| 4,838,453 | 6/1989 | Luckstead | 221/2 |
| 4,911,327 | 3/1990 | Shepherd et al. | 221/3 |
| 5,044,516 | 9/1991 | Hoar | 221/2 |
| 5,152,422 | 10/1992 | Springer | 221/2 |
| 5,176,285 | 1/1993 | Shaw | 221/3 |
| 5,246,136 | 9/1993 | Loidl | 221/3 |
| 5,323,929 | 6/1994 | Marlar | 221/3 |
| 5,329,459 | 7/1994 | Kaufman et al. | 221/2 |
| 5,472,113 | 12/1995 | Shaw | 221/7 |
| 5,657,236 | 8/1997 | Conkright | 221/2 |

*Primary Examiner*—Kenneth Noland
*Attorney, Agent, or Firm*—David Pressman

[57] ABSTRACT

A device that can be loaded with appropriate pills and programmed to automatically dispense the proper amount(s) and proper type(s) of pill(s) at the proper time(s) each day. The device also includes a system for alerting the pill taker that pills have been dispensed and need to be taken, a system for providing voice messages to coach the pill taker to use the device and consume the pills, a system for alerting an off-site caregiver when the pill taker has not responded as required or when there is a problem with the operation of the device, and a system for the efficient and accurate loading of pills into the device. Major components of the device include a pill storage wheel (100), a cabinet (102), a pill release gate (110), a pill loading indicator template (118), a programmable timer (130), a power spring (134), an index wheel (138), a double ended pawl assembly (144), a solenoid assembly (146), a battery (500), an one shot timing and solenoid driving circuit (504), a blinking LED and buzzer driver circuit (506), a voice message record and playback system (514), and an automatic telehone dialer system (510).

34 Claims, 10 Drawing Sheets

PROGRAMMABLE AUTOMATIC PILL DISPENSER WITH PAWL INDEXING MECHANISM

BACKGROUND

1. Field of Invention

This invention relates to automatic pill dispensers, particularly to methods and devices which may be programmed to automatically dispense predetermined quantities and preselected types of pills at preset times.

BACKGROUND

2. Prior Art

The usage of pills to regain and maintain health has increased with the advancement of medical science. It is not unusual for a person to take more than one type of pill, each type in a different amount, at regular times each day. The task of correctly taking several different types of pills pose a challenge to many individuals, especially the elderly, the mentally infirm, and the obtunded who are more susceptible to memory problems. The improper taking of pills may be detrimental to health, and many emergency hospital admissions are attributable to improper observance of pill prescriptions.

The need for a device which will automatically dispense the proper pill(s) in the proper amount(s) at the proper time(s) each day and alert the user of the device to take the dispensed pill(s) is evident by the numerous devices described in the prior art. However, there are problems with the devices described in the prior art. For example, U.S. Pat. Nos. 4,573,606 to Lewis et al. (1986), 4,674,651 to Scidmore et al. (1987), 4,838,453 to Luckstead (1989), and 5,044,516 to Hoar (1991) describe automatic pill dispensers which have pill storage wheels that are rotated constantly by electric clock motors. The constantly rotating pill storage wheel of these devices successively moves each pill storage compartment of the wheel into a temporary alignment with a pill discharge outlet at a cyclical and fixed time interval. When a pill storage compartment is in alignment with the pill discharge outlet, any pill stored in the compartment will fall by gravity through the outlet into a pill receptacle. The length of the fixed time interval of these devices cannot be changed without changing the gear drive ratio of the gear system driving the pill storage wheel. Discharging pills at fixed time intervals makes these devices inefficient and difficult to use. For example, if one of these devices constantly rotates three pill storage compartments past its pill discharge outlet in a 24-hour period, but only one pill is needed each day, then only one pill storage compartment is used and two are kept empty each 24-hour day. In this case, two out of three pill storage compartments have no use. In addition, during the process of loading pills into the pill storage wheel, specific compartments must be kept empty; this makes the loading procedure more complicated and susceptible to error.

Automatic pill dispensers which do not employ rotating pill storage wheels are also known. For example, U.S. Pat. No. 4,763,810 to Christiansen (1988) shows a device which uses a series of pill storage compartments which are arrayed in a checkerboard fashion and U.S. Pat. No. 4,798,309 to Stone et al. (1989) shows a device which uses a series of pill storage compartments which are spirally arranged on an elongate cylinder. Although these examples seem to be different, the basic operating principle of all these dispensers are nontheless similar and have the following characteristics in common:

1) They all have a series of pill storage containers.

2) Each pill storage container is capable of:

a) allowing the loading of pills into the container, b) storing all the pills that are dispensed at any time, and c) allowing the stored pills to discharge by the force of gravity when the container registers with a pill discharge outlet.

3) They all have a pill discharge outlet that allows the stored pills to discharge by gravity from a single loaded container that is in alignment with the pill discharge outlet.

4) They all have a means for sequentially bringing each loaded container into registration with the pill discharge outlet at preset times.

Christiansen and Stone use stepper motors and microprocessors to effect the registration of a loaded pill storage container with the discharge outlet only at preset times for dispensing the pills so that all of the pill storage containers are efficiently utilized; however, the mechanisms of these dispensers are complicated and expensive.

Another problem with all of these devices is the possibility of an overdose of dispensed pills. This may result when a device dispenses pills into the pill receptacle, but the person taking the dispensed pills for some reason did not respond to the alert signal or just turned off the alert signal without taking the pills. If the dispensed pills are not removed from the pill receptacle and more pills are discharged into the receptacle, overdosing with harmful consequences may occur if the pill taker consumes all of the pills accumulated in the pill receptacle.

Shaw, in U.S. Pat. No. 5,176,285 (1993) attempts to overcome this deficiency. A pill is not released from Shaw's pill storage wheel unless a motorized mechanism is actuated to remove the pill, making an accumulation of discharged pills less likely. However, Shaw's device is complicated, difficult to load with pills and use, and uses motors and controls which are neither simple nor economical.

Another deficiency of all these devices is that some users, especially those suffering from senility or deterioration of mental function, may simply deactivate the pill alert signal as they would do when turning off an alarm clock, and forget to take the dispensed pills. In addition, there may be special instructions that the pill taker must follow in consuming the dispensed pills, such as taking the dispensed pills with plenty of liquids, or food, and the pill taker may forget these instructions. Also, the devices of Lewis et al. and Hoar have removable pill receptacles that must be replaced after the dispensed pills are taken, and an user may forget to replace the receptacle. Knowing when to refill the dispenser with pills is another problem with all of the devices. Also, a person monitoring the use of a dispenser must be close to the dispenser to make observations, and this could be inconvenient.

OBJECTS AND ADVANTAGES

Accordingly, several objects and advantages of the present invention are to provide an improved programmable automatic pill dispenser, and to provide a dispenser which facilitates the task of caregivers in nursing homes to efficiently administer the proper pill(s) in the proper amount(s) at the proper time(s) to a patient. Further objects and advantages are to provide a simple and reliable programmable automatic pill dispenser that has a pill storage wheel which moves only at preset time(s), and to provide an easy to use pill loading indicator system for accurate and efficient loading of pills into the pill storage wheel.

An enhanced embodiment provides a programmable automatic pill dispenser for use by people, such as senior citizens, who have problems in remembering to take pills properly but could otherwise still live independently. This embodiment can enable these people to take the proper pill(s) in the proper amount(s) at the proper time(s) without an on-site caregiver to administer the pill(s).

Further objects and advantages are:

a) to provide a programmable automatic pill dispenser that reduces the possibility of the pill taker taking an improper accumulation of dispensed pills which may result in overdosing;

b) to provide a programmable automatic pill dispenser that has a system to record personal voice messages and to play these messages to coach the pill taker into properly taking the dispensed pills;

c) to provide a programmable automatic pill dispenser that has a system to alert an off-site caregiver when the pill taker has not taken the dispensed pill(s), or when there is a problem with the operation of the programmable automatic pill dispenser; and d) to provide a programmable automatic pill dispenser that is compact, mechanically spring powered, and battery operated.

Additional objects and advantages will become apparent in studying the ensuing drawings and description.

DRAWING FIGURES

Figure 1:
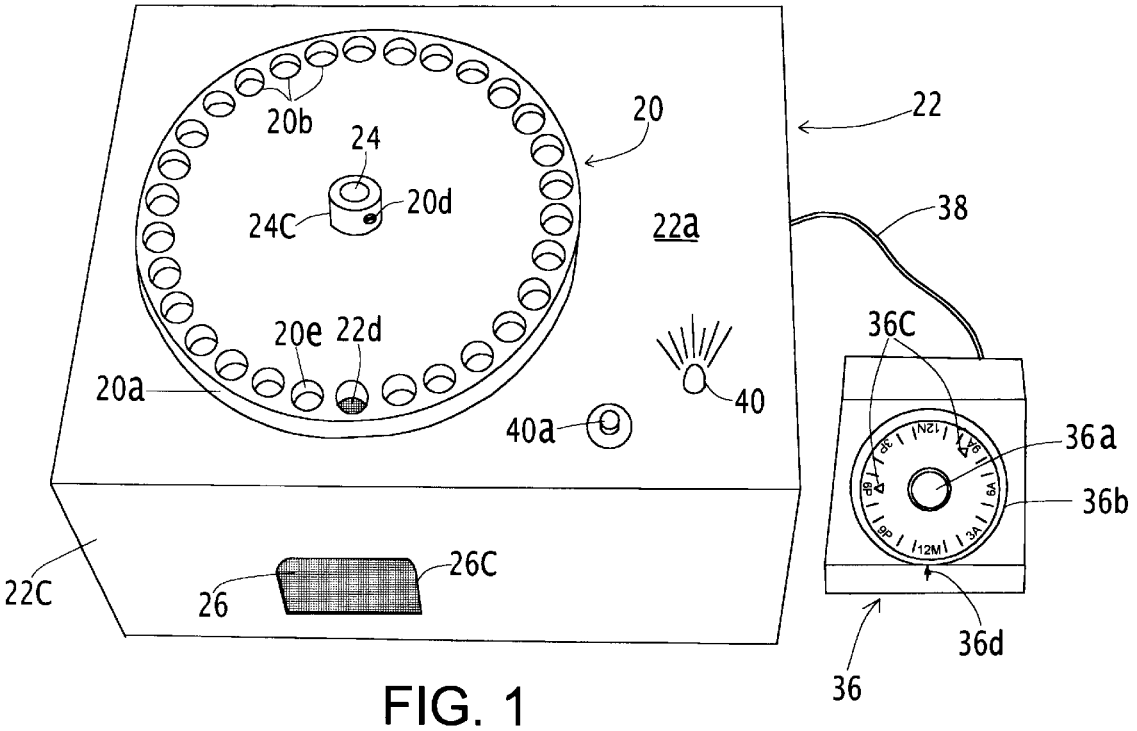
FIG. 1 is a perspective view of a basic embodiment of a programmable automatic pill dispenser in accordance with the present invention.

Reference Numerals In FIGS. 1 to 3D

20 pill storage wheel
20*a* circular disk
20*b* holes
20*c* hub
20*d* set screw
20*e* pill storage compartment
22 cabinet
22*a* platform surface-top side
22*b* platform surface-bottom side
22*c* walls
22*d* pill discharge outlet
24 shaft
24*a* shaft bearing hole
26 pill receptacle
26*a* receptacle floor
26*b* receptacle walls
26*c* receptacle access hole
28 index wheel
28*a* hub
28*b* set screw
28*c* disk
28*d* tooth
30 detent mechanism
30*a* roller
30*b* lever
30*c* roller shaft
30*d* pivot pin
30*e* spring
30*f* spring retainer
30*g* pin on lever 30*b*
32 articulated pawl mechanism
32*a* pawl
32*b* lever
32*c* connecting pin
32*d* pivot pin
32*e* spring
32*f* fixed pin spring retainer
32*g* spring
32*h* pin on pawl 32*a*
32*i* pin on lever 32*b*
34 solenoid assembly
34*a* link
34*b* solenoid plunger
34*c* pin on plunger 34*b*
34*d* fasteners
36 programmable timer
36*a* knob
36*b* clock dial
36*c* tripper pins
36*d* time of day indicator
38 electric cable
40 pill alert indicator light
40*a* indicator reset switch

Reference Numerals In FIGS. 4 to 10

100 pill storage wheel
100*a* cylindrical cavity
100*b* radial vanes
100*c* outer cylindrical wall
100*d* radial block
100*e* annular surface
100*f* inner cylindrical wall of cavity 100*a*
100*g* circular base of cavity 100*a*
100*h* hole through center of 100*g*
100*i* fastener holes through 100*g*
100*j* finger hole
102 cabinet
102*a* pill storage wheel housing
102*b* pill receptacle housing
102*c* pill vial storage compartment
102*d* rear compartment (FIGS. 6&7)
102*e* inner cylindrical surface of 102*a*
102*f* circular base surface of 102*a*
102*g* shaft bearing hole
102*h* base surface of rear compartment 102*d*
102*i* pill discharge outlet
104 cabinet door
104*a* hinges
104*b* latch

106 hollow shaft and flange
106*a* fastener holes in flange
108 pill storage compartment
110 pill release gate
110*a* gate shaft
110*b* gate shaft bearing hole
112 gate push-button
114 pill box
116 pill box contact switch
118 pill loading indicator template
118*a* template retaining post
118*b* template retainer
118*c* template retaining hole
118*d* template retaining hole
120*a* pill loading indicator label
120*b* pill loading indicator label
120*c* pill loading indicator label
122 LED indicator (pill alert)
124 LED indicator (pill storage wheel refill)
126 LED indicator (low battery)
128 acoustical outlet grille
130 programmable timer
130*a* hollow tube
130*b* knob
130*c* clock dial
130*d* current time pointer
130*e* tripper pin
130*f* tripper pin
132 drive drum
132*a* fastener holes
134 power spring
136 take up drum
136*a* pivot pin
138 index wheel
138*a* center hole
138*b* fastener holes
138*c* tooth
138*d* stop pin
138*e* switch tripper
140 straddle clamp block
140*a* hole for receiving tube 130*a*
140*b* slit
140*c* screw and nut
140*d* fastener holes
140*e* stop screw or pin
140*f* fasteners
142 refill indicator switch
144 double ended pawl assembly
144*a* bar
144*b* pawl pin #1
144*c* pawl pin #2
144*d* bar pivot hole
144*e* pivot pin
144*f* spring retainer
144*g* connecting pin
144*h* raised platform
144*i* fasteners
144*j* extension spring
144*k* spring retainer
144*l* plate bracket
146 solenoid assembly
146*a* solenoid plunger
146*b* connecting link
146*c* plunger connecting pin
148 rack and pinion assembly
148*a* push button stem
148*b* hole in cabinet top for 148*a*
148*c* retaining clip
148*d* recess
148*e* rack bar
148*f* rack teeth
148*g* retainer guides
148*h* guide fasteners
148*i* pinion
148*j* rack return spring
148*k* spring guide
148*l* spring retainer and rack stop
148*m* fasteners
150 switch
150*a* fasteners
500 battery
502 pill refill indicator circuit
504 one shot timing and solenoid driving circuit
506 blinking LED and buzzer driver circuit
508 alert duration timer circuit
510 automatic telephone dialer system
512 buzzer
514 voice message record and playback system
516 voice message #1 timer circuit
518 voice message #2 record and loop play circuit
520 voice message #2 timer circuit
522 low voltage detection circuit

Figure 2:
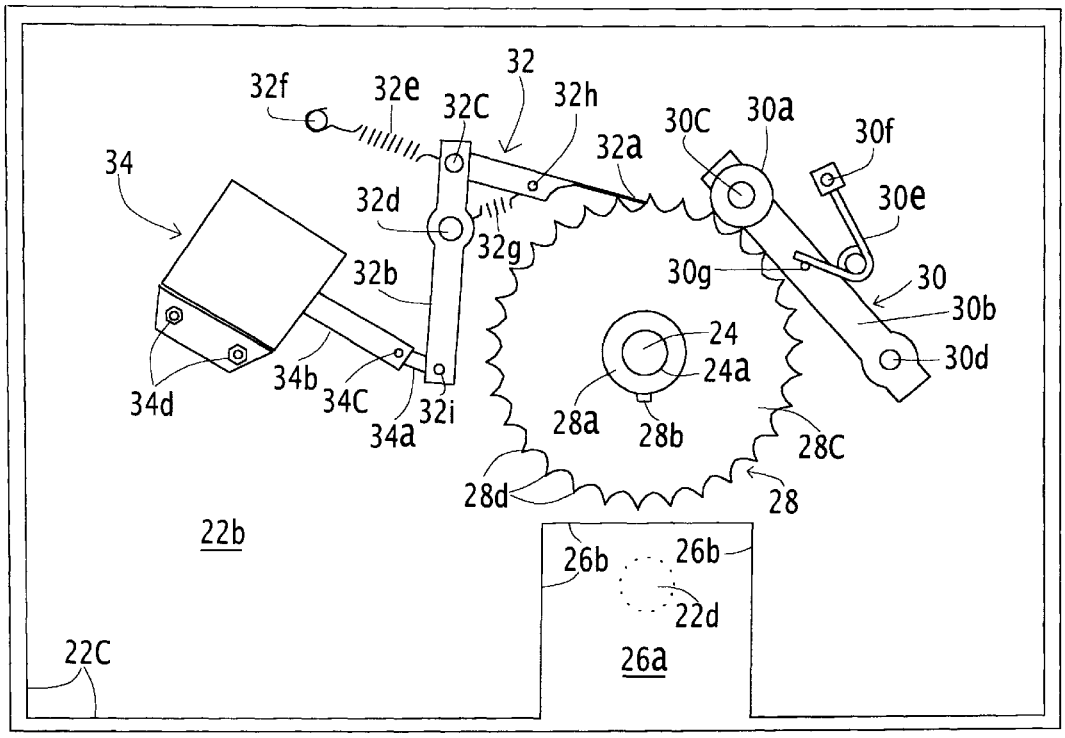
FIG. 2 is a bottom view of the dispenser of FIG. 1 without a programmable timer.

Description of Basic Embodiment—FIGS. 1 and 2

The basic embodiment of the programmable automatic pill dispenser (FIGS. 1 and 2) comprises a pill storage wheel 20 having a disk 20*a* that has a series of through holes 20*b* which are concentrically located on the disk. Wheel 20 also has a hub 20*c* and a set screw 20*d*.

A cabinet 22 has an elevated platform with an upper surface 22*a* and a lower surface 22*b* which are structurally supported by walls 22*c*. The pill storage wheel and cabinet may be constructed of various suitable materials, such as metal or plastic.

Wheel 20 is supported on surface 22*a*. Holes 20*b* and surface 22*a* cooperate to form pill storage compartments 20*e*. The pill storage capacity of compartment 20*e* depends upon the size of hole 20*b* and the thickness of disk 20*a*. Although holes 20*b* are shown as circular in FIG. 1, the holes may be any shape which will form compartments or containers suitable for the storage requirements of the pills. The pill storage compartments need to be a size and shape which will avoid jamming of the pills stored in the compartment and avoid making it difficult for the pills to fall out of the compartment by gravity.

A shaft 24 is placed in a shaft bearing hole 24*a* through the platform. Shaft 24 extends beyond upper and lower platform surfaces 22*a* and 22*b*. Wheel 20 is fastened to the upper end of shaft 24 by set screw 20*d*.

A pill discharge outlet 22*d* through platform surfaces 22*a* and 22*b* is located under the path of traversing holes 20*b* when the pill storage wheel is rotated. The size and shape of outlet 22*d* must allow all pills stored in a single compartment 20*e* to flow through outlet 22*d* with minimal hindrance when hole 20*b* is aligned with outlet 22*d*.

Beneath outlet 22*d* is a pill receptacle 26 which is comprised of a floor 26*a* and walls 26*b*. Receptacle 26 may be integrated as a component of cabinet 22. A pill receptacle access hole 26*c* in the front wall should be sized to allow entry of fingers to retrieve dispensed pills.

The lower end of shaft 24 (FIG. 2) is attached to an index wheel 28 at its hub 28*a* with a set screw 28*b*. Index wheel 28 comprises a disk 28*c* that has a series of projections or teeth 28*d* at its circumference. Each tooth of index wheel 28 corresponds to a hole 20*b* of wheel 20. The angular displacement between one tooth and another tooth on index wheel 28 is equal to the angular displacement between the corresponding holes 20*b* of wheel 20.

A roller 30*a* of a detent mechanism 30 engages two adjacent teeth of index wheel 28. Roller 30*a* is connected to a lever 30*b* by roller shaft 30*c*. Lever 30*b* is mounted on a pivot pin 30*d* that is affixed to surface 22*b*. A spring 30*e* applies force against a pin 30*g* on lever 30*b*. Spring 30*e* is held by a retainer 30*f* that is affixed to surface 22*b*. Detent mechanism 30 is positioned and affixed to surface 22 so that hole 20*b* is aligned with outlet 22*d* when roller 30*a* is in a resting position.

A pawl 32*a* of an articulated pawl mechanism 32 engages a tooth of index wheel 28. Pawl 32*a* is connected to a lever 32*b* by a pin 30*c*. Lever 32*b* is mounted on a pivot pin 32*d* that is affixed to surface 22*b*. One end of a spring 32*e* is connected to pin 30*c* and the other end is connected to a pin 32*f* that is affixed to surface 22*b*. One end of a spring 32*g* is connected to pivot pin 32*d* and the other end to a pin 32*h* on pawl 32*a*. One end of a link 34*a* is connected to lever 32*b* by a pin 32*i*.

The other end of link 34*a* is connected by a pin 34*c* to a solenoid plunger 34*b* of a solenoid assembly 34. Assembly 34 is affixed to surface 22*b* by two fasteners 34*d*. Pawl mechanism 32 and solenoid assembly 34 are accordingly sized and positioned on surface 22*b* so that when the solenoid is energized, pawl 32*a* will push tooth 28*d* to rotate index wheel 28 to the next tooth position. A further explanation is given in the description of operation.

A programmable timer 36 is connected by an electrical cable 38 to an electrical circuit (not shown) inside cabinet 22. Programmable timer 36 is a 24-hour clock with a multiple event programmable time controlled switch; it is like those commercially available for household use in turning on and off an appliance or lamp at preset times. Since pills are usually taken at the same preset time(s) each day, and a 24-hour programmable timer is appropriate. However, if pills are taken at different preset time(s) each day, a 7-day or longer programmable timer would be used. Although timer 36 is shown as an analog clock timer, a digital type may be used. A discharged pill alert indicator light 40 is positioned on surface 22*a* and is a bright blinking light. A pushbutton switch 40*a* turns off indicator light 40.

Although the electrical circuit is not shown in the drawings, the circuitry mainly comprises wiring for energizing the solenoid and turning on the blinking light latch circuit when timer 36 switches on at the preset time.

Operation of the Basic Embodiment—FIGS. 1 and 2

First, the caregiver or person using the dispenser sets timer 36 to the current time by turning a knob 36*a* until the current time is indicated on dial 36*b* by pointer 36*d*. Next, the user determines the preset time(s) that pill(s) need to be dispensed. The user programs timer 36 to switch on at the preset time(s) by placing tripper pin(s) 36*c* on dial 36*b* at the preset time(s). For example, timer 36 in FIG. 1 has tripper pins set at preset times of 9 AM and 6 PM. If pills need to be dispensed at additional preset times, additional tripper pins are placed accordingly.

In consumer-type programmable timers for controlling household appliances, trippers need to be set to turn off the time controlled switch in addition to the trippers for turning on the switch. In the operation of the dispenser, solenoid assembly 34 need be energized only less than a second; a longer duration will work but wastes electrical energy. Hence, if a consumer-type timer is used, the OFF tripper should set after each preset time for the shortest duration possible. In consumer-type digital timers, the shortest on-off duration is usually one minute. In place of a commercially available timer, a timer specially designed for the programmable automatic pill dispenser may be used. The specially designed timer may employ a "one-shot" timing circuit (monostable multivibrator) that will provide a single pulse of electrical current at each preset time and will obviate the need for OFF trippers.

After timer 36 has been programmed, the pill dispenser is properly loaded with pills. If there is only one preset time for pills to be dispensed each day or if there are multiple preset times per day with the same pills for each preset time, then the pill loading operation is very simple because every compartment of wheel 20 is loaded with the same type(s) and amount(s) of pill(s). When there are multiple preset times per day with different pills for each preset time, the type(s) and amount(s)of pill(s) to be dispensed at each preset time are first determined. The pill(s) for each preset time are loaded into the pill storage wheel in the same order as the preset times sequentially appear each day.

Accordingly the loading operation commences with the loading of pills for the approaching preset time into the approaching pill storage compartment of wheel 20. Since wheel 20 shown in FIG. 1 advances in a counterclockwise direction, the next compartment 20*e* advancing in a counterclockwise direction to outlet 22*d* is the approaching pill storage compartment. Timer 36 in FIG. 1 shows preset times of 9 AM and 6 PM, and the clock dial shows a current time of 12 midnight. An impending preset time nearest the current time is the approaching preset time; the approaching preset time in this case is 9 AM. Therefore, the approaching or first compartment is loaded with pills for 9 AM, the second compartment from outlet 22*d* in a clockwise direction is loaded with pills for 6 PM, the third compartment is loaded with pills for 9 AM again, and so on. All of the compartments may be loaded except for the one that is resting over outlet 22*d*.

If the pills are to be dispensed over a time frame less than allowed by the capacity of the pill storage wheel, then not all of the compartments are loaded. For loading operations which involve many preset times with different types and amounts of pills, a pill loading indicator system that is described in the description of the enhanced embodiment may be used to facilitate the loading process. After timer 36 has been programmed and wheel 20 has been properly loaded with pills, the dispenser is ready to dispense pills. The dispenser is placed in a secure location, easily visible to the caregiver or user. A cover or enclosure may be used to protect the loaded pill storage wheel; obviously, such a cover or enclosure must removable to provide access for the loading of pills.

Operation of the Index Wheel Advancing Mechanism—FIGS. 3A to 3D

Figure 3A:
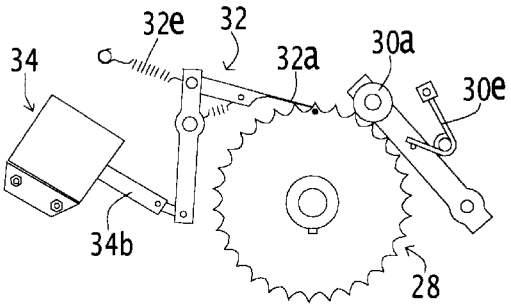
FIGS. 3A through 3D are plan views showing the sequential operation of a mechanism for advancing an index wheel of FIG. 2.

When the clock of timer 36 arrives at a preset time, timer 36 will switch on to allow electrical current to briefly energize solenoid assembly 34. FIGS. 3A through 3D show how solenoid assembly 34 moves index wheel 28, and consequently moves the approaching pill storage compartment to rest over outlet 22*d*. FIG. 3A shows the position of solenoid assembly 34, articulated pawl mechanism 32, index wheel 28, and detent mechanism 30 before the solenoid is energized. Spring 32*e* holds solenoid plunger 34*b* in an extended position. Spring 32*g* holds the tip of pawl 32*a* on index wheel 28 at the tooth that is identified with a black dot in the drawing. Spring 30*e* holds detent roller 30*a* against index wheel 28 with the roller resting between two adjacent teeth to prevent any unnecessary movement of the index wheel.

Figure 3B:
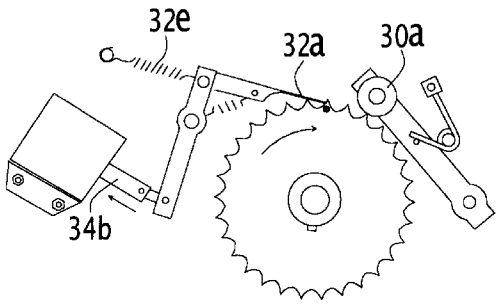

FIG. 3B shows the solenoid being energized and solenoid plunger 34*b* being retracted. The force exerted by retracting solenoid plunger 34*b* overcomes the force of spring 32*e* and pushes pawl 32*a* against the index wheel tooth to rotate the index wheel. During the same time, detent roller 30*a* is lifted by the rotating index wheel.

Figure 3C:
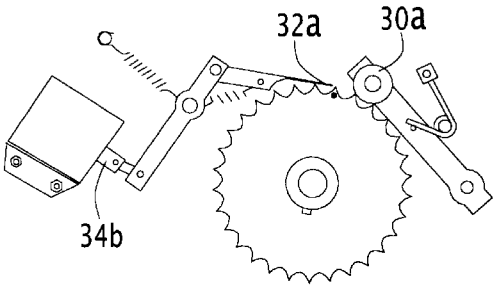

FIG. 3C shows solenoid plunger 34*b* fully retracted and pawl 32*a* extended at the end of its travel. The index wheel has rotated so that detent roller 30*a* rests between the next successive set of teeth on the index wheel.

Figure 3D:
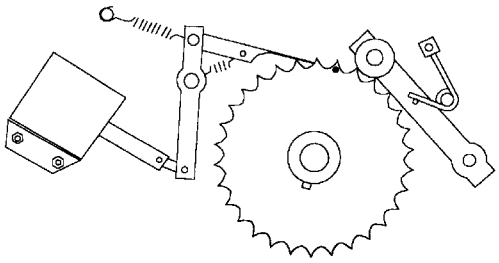

FIG. 3D shows the position of the mechanism when the electrical current to the solenoid has been turned off. The mechanism returns to a position similar to that of FIG. 3A, except the tooth with the black dot has moved by one tooth position.

Since index wheel 28 and wheel 20 are both fastened to shaft 24, the movement of the index wheel by one tooth position will also result in the movement of the approaching pill storage compartment to the position over outlet 22*d*. The pills in the compartment fall by gravity into receptacle 26.

The latch circuit of pill alert indicator light 40 is switched on by the electrical current that energizes the solenoid. The blinking light alerts the caregiver or user to remove the dispensed pills in the pill receptacle. The pill indicator latch circuit is turned off by pushing switch 40*a* when the pills are removed. The pill dispenser now awaits the next preset time to repeat the just-described electro-mechanical process. The caregiver or user monitors and reloads the dispenser with pills as needed.

Description of the Enhanced Embodiment—FIGS. 4 through 7

Figure 4:
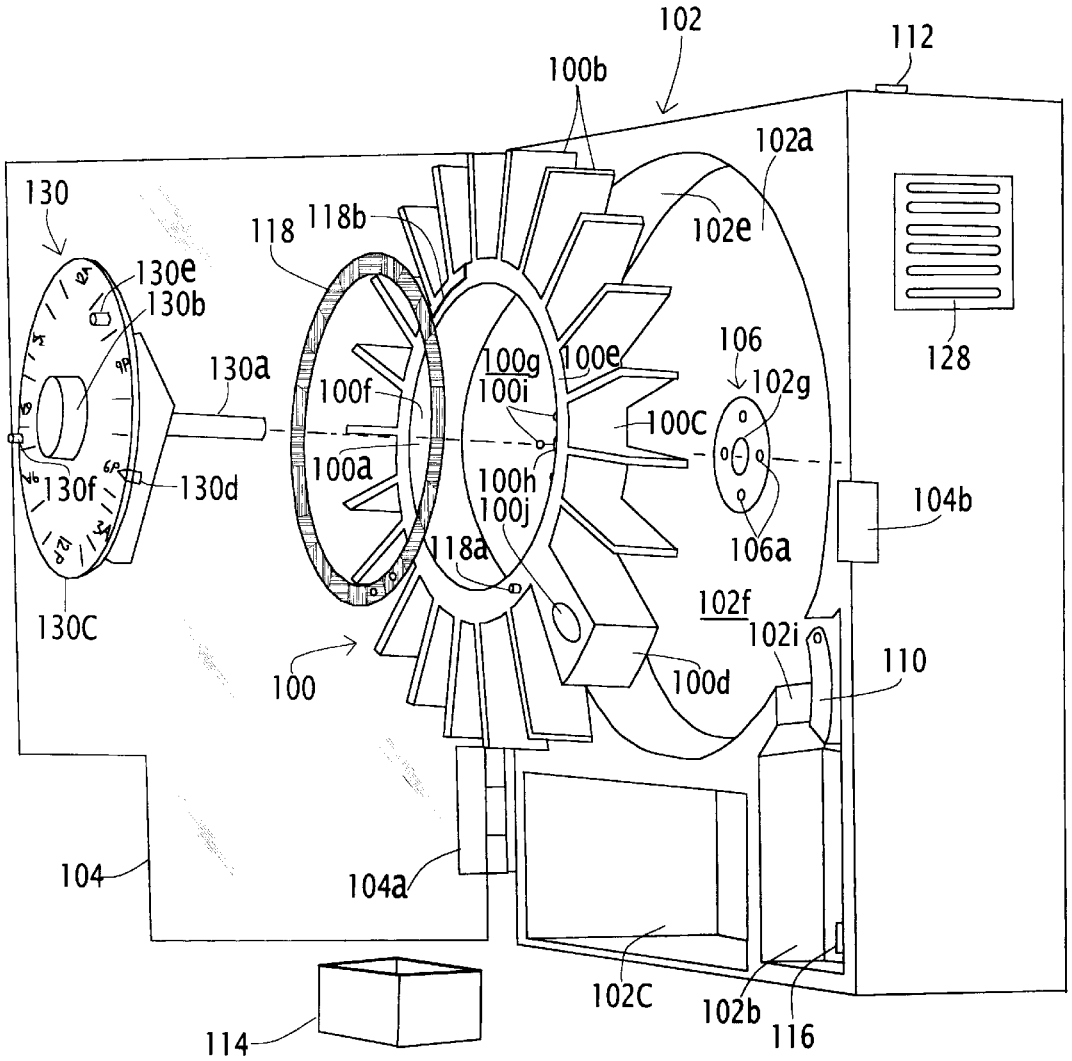
FIG. 4 is a perspective, exploded front view of an enhanced embodiment of the dispenser in accordance with the present invention.
Figure 5:
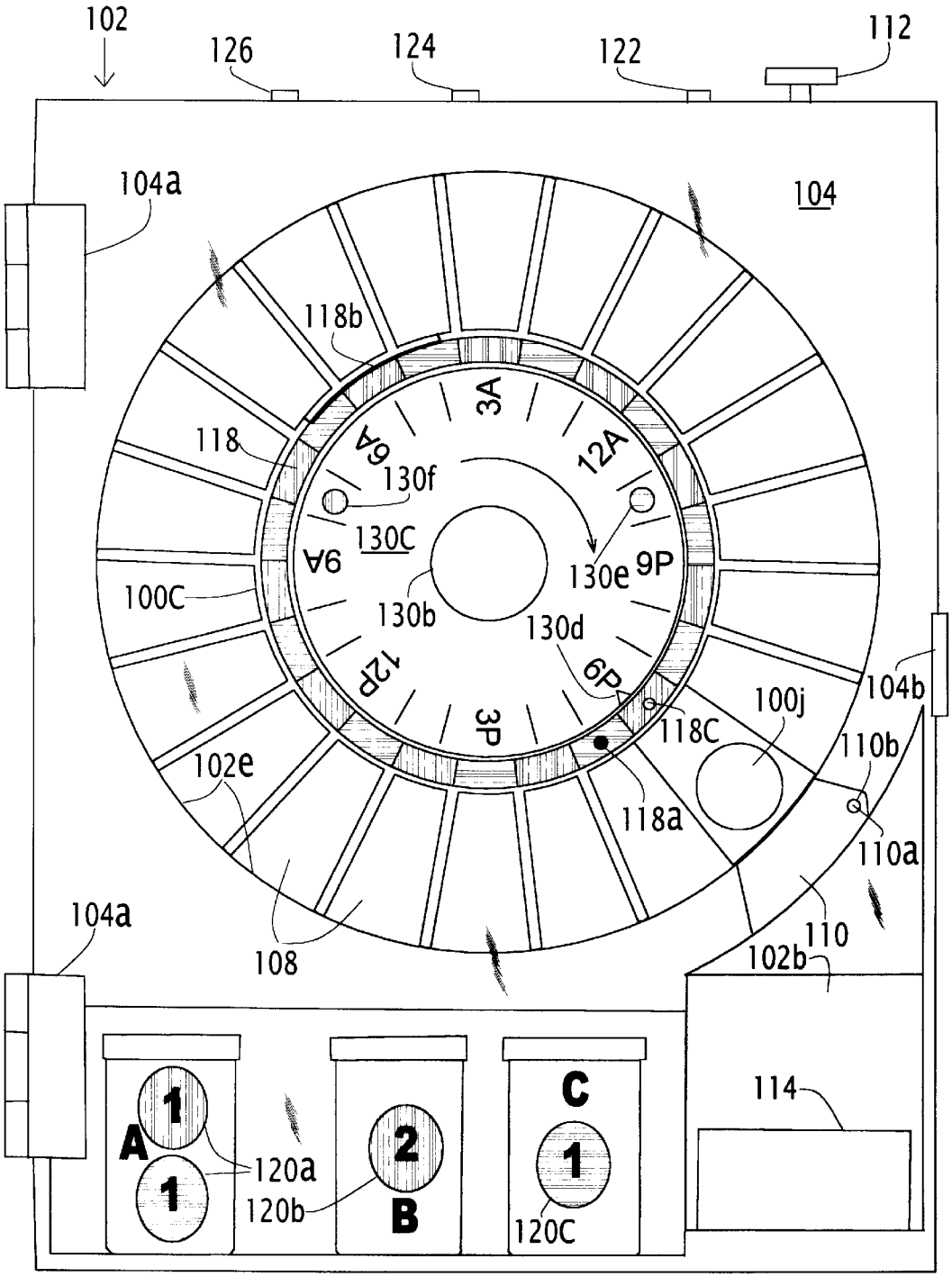
FIG. 5 is a front view of the dispenser of FIG. 4.

Looking at FIGS. 4 and 5, a pill storage wheel 100 comprises a cylindrical cavity 100*a*, a series of equal size radial vanes 100*b* extending from an outer cylindrical wall 100*c* of cavity 100*a*, a radial block 100*d* extending from wall 100*c*, and an annular surface 100*e*. Cavity 100*a* comprises of an inner cylindrical wall 100*f*, a circular base 100*g*, a hole 100*h* through the center of base 100*g*, and four fastener holes 100*i* through base 100*g*. Radial block 100*d* has a finger hole 100*j*.

Figure 6:
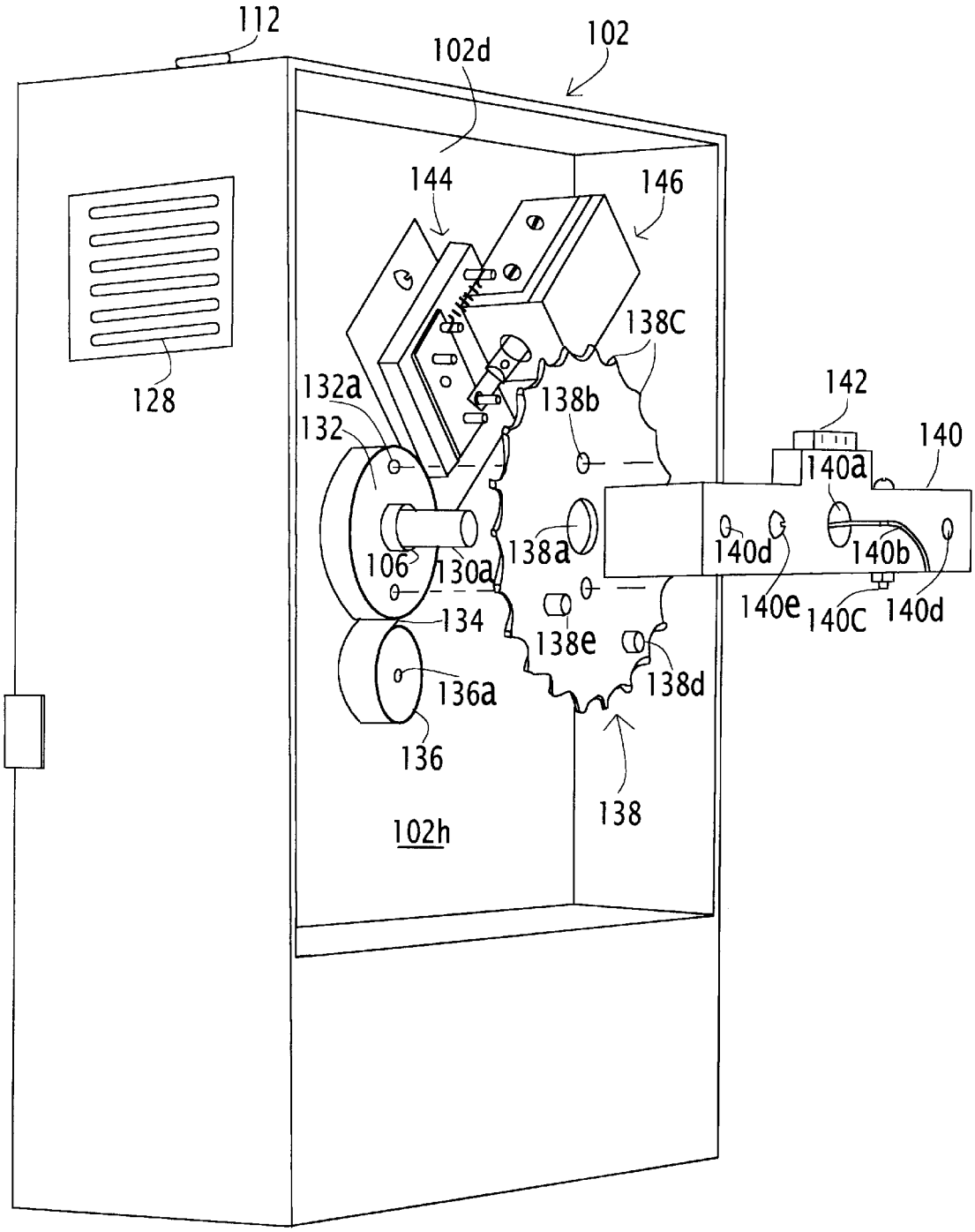
FIG. 6 is a perspective back view of the dispenser of FIG. 4 with an exploded view of an index wheel advance mechanism.
Figure 7:
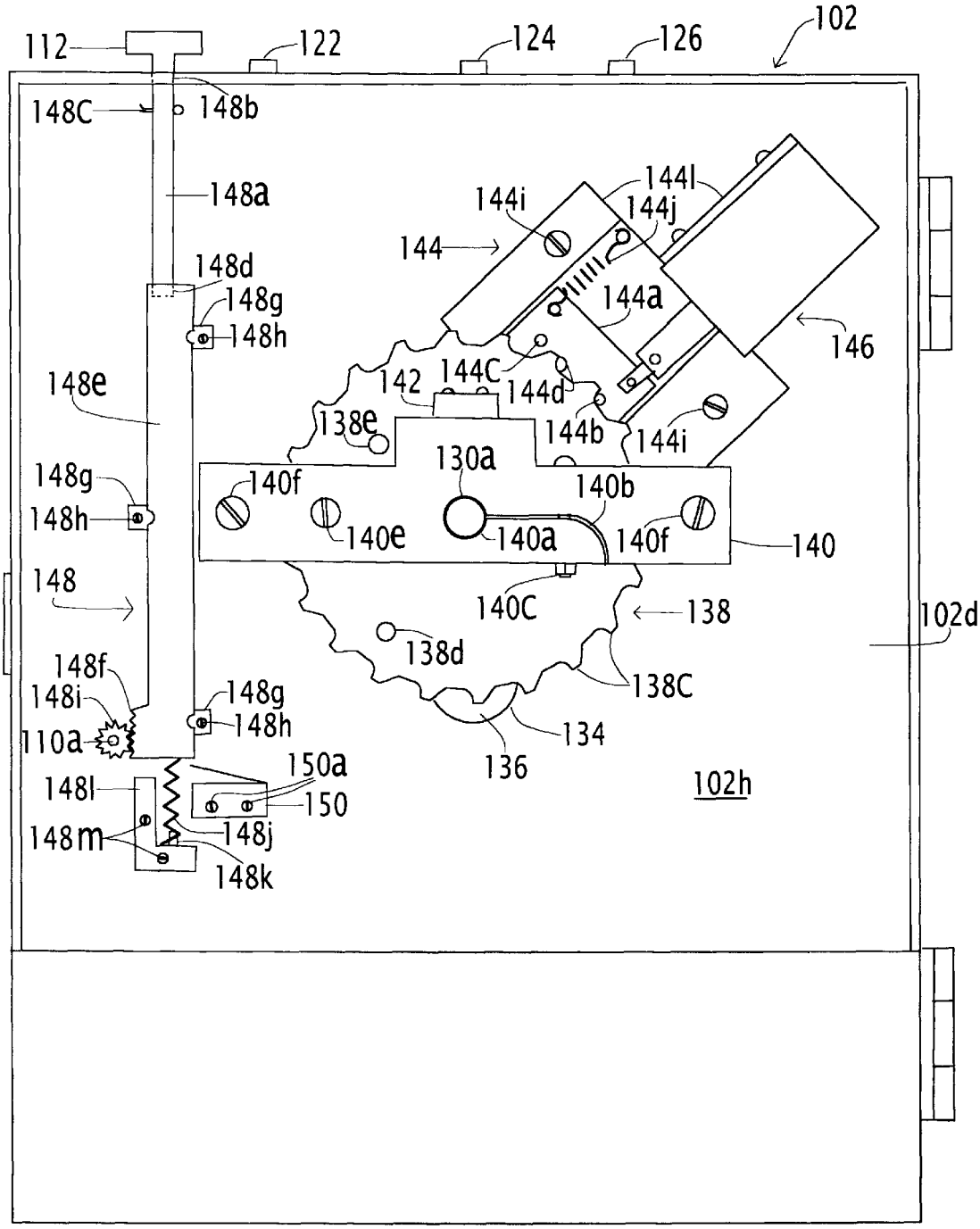
FIG. 7 is a back view of the dispenser of FIG. 4.

A cabinet 102 comprises a pill storage wheel housing 102*a*, a pill receptacle housing 102*b*, a pill vial storage housing 102*c*, and a rear compartment 102*d* (shown in FIGS. 6 and 7). Housing 102*a* has an inner cylindrical surface 102*e* with a pill discharge outlet 102*i*, and a circular base surface 102*f*. Rear compartment 102*d* has a base surface 102*h* that is opposite surface 102*f*. A shaft bearing hole 102*g* at the center of surface 102*f* extends through surface 102*h*. A door 104 is attached to cabinet 102 with hinges 104*a* and is secured closed by a latch 104*b*. The pill storage wheel and cabinet may be constructed of various suitable materials, such as metal or plastic. The cabinet door is preferably constructed of transparent plastic.

Wheel 100 is fastened to a flange and hollow shaft 106 with fasteners (not shown) through holes 100*i* and 106*a*. The pill storage wheel and attached shaft are disposed in housing 102*a* with shaft 106 supported in hole 102*g* and the shaft extends beyond surface 102*h* of the rear compartment. Wheel 100 disposed in housing 102*a* combined with door 104 cooperate to form a series of pill storage compartments 106. In addition to containing the stored pills, door 104 serves to provide access for loading pills into the pill storage compartments. For the compartments to be effective, the gaps formed at the outer and radial edges of radial vanes 100*b* with surface 102*e*, surface 102*f*, and door 104 must be small to prevent the wedging of thin pills in the gaps when the vanes move.

A modified pill storage wheel that has more structure may be used to eliminate any problem due to excessive gaps at the radial edges of the radial vanes. The modified pill storage wheel is like wheel 100 except it has two thin flat annular disks additionally attached so that all the radial edges of the radial vanes on both faces of the pill storage wheel are covered by the annular disks which rotates with the modified wheel. Only the gaps between the outer edges of the radial vanes and the inner cylindrical surface 102*e* will be of any significance with the modified wheel. The annular disk that is adjacent to door 104 must be removable to provide access for loading the modified pill storage wheel with pills. If desired, door 104 may be omitted when the modified pill storage wheel is used.

A pill release gate 110 is interposed in cylindrical surface 102*e* to cover pill discharge outlet 102*i*. Gate 110 is affixed to a pivot shaft 110*a* that is supported by a shaft bearing hole 110*b* through surface 102*f* and surface 102*h*. Shaft 110*a* extends beyond surface 102*h*. The inside surface of gate 110 follows the contour of surface 102*e*. The area covered by gate 110 is the area on surface 102*e* between two adjacent radial vanes 100*b*. A pushbutton 112 protruding from the top of cabinet 102 operates gate 110.

Beneath gate 110 is a pill receptacle housing 102*b*. Housing 102*b* provides space for gate 110 when the gate is opened, and space for placement of a removable pill receptacle or box 114. Also located in housing 102*b* is a contact switch 116 that is actuated by the removal and replacement of pill box 114.

A pill loading indicator template 118 is an annular shaped piece of thin flat metal, plastic, or other suitable material of a size to fit on annular surface 100*e* of wheel 100. Template 118 is divided into sectors or areas which correspond with the pill storage compartments of wheel 100, and the template sectors are identified with distinctive indicants. The template sectors are either marked with specific symbols or covered with specific colors to assign a specific symbol or a specific color code for each pill storage compartment. The pill loading indicator template shown in FIGS. 4 and 5 is an example template that uses two colors as distinctive indicants. The vertical hatch lines in the drawings indicate a green color and the horizontal hatch lines indicate a yellow color. Hence the colors of the successive sectors of template 118 in FIGS. 4 and 5 are alternating green and yellow. Template retaining hole 118*c* is in a green sector and hole 118*d* in a yellow sector adjacent to hole 118*c*. There is a template retaining post 118*a* protruding from annular surface 100*e* near the adjacent compartment counterclockwise from radial block 100*d*. A template retainer 118*b* is located opposite to post 118*a*. Template 118 is held on annular surface 100*e* by placing template retaining hole 118*c* or 118*d* over post 118*a* and securing template 118 to template retainer 118*b*.

Numerals 120*a*, 120*b*, and 120*c* depict pill loading indicator labels placed on pill supply vials A, B, and C in pill vial storage compartment 102*c*.

A blinking LED 122 is a bright blinking light emitting diode indicating the availability of dispensed pills. An LED 124 is an indicator light signifying the need to refill the pill storage wheel. An LED 126 is an indicator light signifying the need to replace batteries. An acoustical outlet grille 128 facilitates emanations of an alert buzzer 512 and recorded voice messages which will be described later.

A programmable timer 130 is held by a fixed hollow tube 130*a* that also serves as a conduit for wiring from timer 130. Timer 130 is disposed in cavity 100*a*, and tube 130*a* is disposed through hole 100*h* and hollow shaft 106. The length of tube 130*a* is longer than hollow shaft 106. Numeral 130*b* is the clock setting knob of timer 130. Numeral 130*c* is the clock dial. Numeral 130*d* is the current time pointer. Numerals 130*e* and 130*f* are tripper pins of timer 130 which are colored coded.

Components in the Rear Compartment—FIGS. 6 through 8C

A drive drum 132 is affixed to hollow shaft 106. One end of a power spring 134 is fastened to drum 132. The other end of spring 134 is wound on a take-up drum 136. Drum 136 is pivoted on a pivot pin 136*a* that is attached to base surface 102*h*. Spring 134 is preferably a flat constant force spring that will apply a constant force to drum 132 and produce a constant torque on hollow shaft 106.

An index wheel 138 comprises a disk with a center hole 138*a*, fastening holes 138*b* about the center hole, and a series of projections or teeth 138*c* at its circumference. There is a tooth on index wheel 138 for each corresponding pill storage compartment of wheel 100. The angular displacement between any two teeth on index wheel 138 is equal the angular displacement between the radial lines through the centers of the corresponding compartments of wheel 100. Index wheel 138 is placed onto hollow shaft 106 and drum 132. Wheel 138 is fastened to drum 132 with fasteners (not shown) at holes 138*b* and 132*a*.

The end portion of tube 130*a* that protrudes from hollow shaft 106 is secured to a straddle clamp block 140. Block 140 has a hole 140*a* with the same diameter as tube 130*a*, a slit 140*b* that intersects hole 140*a*, and a screw and nut 140*c* intersecting slit 140*b*. Tightening screw and nut 140*c* will result in tube 130*a* to be clamped by block 140. Block 140 straddles index wheel 138 and does not interfere with the rotation of the index wheel. Block 140 is fastened to surface 102*h* by fasteners (not shown) through fastener holes 140*d*. As a result, block 140 will hold timer 130 in a stationary position.

The face of index wheel 138 opposite block 140 has a wheel stop 138*d* that is a short pin protruding from the face. Block 140 has a stop pin or screw 140*e* that intercepts wheel stop 138*d* during its rotation. Wheel stop 138*d* is sized and located on index wheel 138 so that a clockwise rotation of wheel 100 will stop when radial block 100*e* registers with gate 110, and a counter-clockwise rotation of the pill storage wheel will stop when the last pill storage compartment (the adjacent compartment counterclockwise from radial block 100*e*) registers with gate 110.

A refill indicator switch 142 is fastened on block 140. A tripper pin 138*e* is located on the face of index wheel 138 so that pin 138*e* will actuate switch 142 when the last pill storage compartment of pill storage wheel 100 registers with gate 110.

Figure 8A:
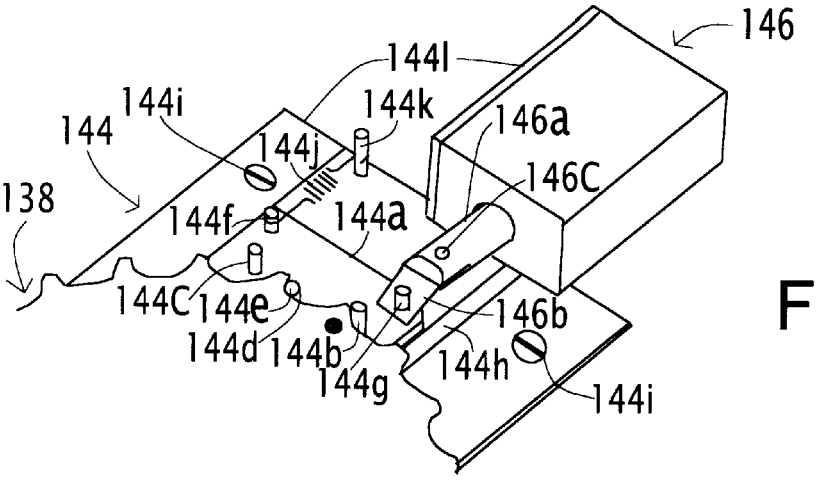
FIGS. 8A through 8C are sequential, perspective views of an index wheel advance mechanism shown in FIG. 7 in operation.

Looking at FIG. 8A, a double ended pawl assembly 144 engages index wheel 138. Assembly 144 has a double ended pawl comprising a flat bar 144*a* with perpendicular pins 144*b* and 144*c* that serve as pawls disposed at each end of the bar. Bar 144*a* also has a pivot hole 144*d*, a bias spring retainer 144*f* located near pin 144*c*, and a connecting pin 144*g* near pin 144*b*. A pivot pin 144*e* is affixed to a raised platform 144*h*. Bar 144*a* is pivoted on pin 144*e* at hole 144*d*. Platform 144*h* is fastened on a plate bracket 144*l* that is secured on surface 102*h* by fasteners 144*i*. One end of an extension spring 144*j* is attached to retainer 144*f*. The other end of spring 144*j* is attached to a retainer 144*k* that is affixed to raised platform 144*h*. Platform 144*h* is located and fastened on surface 102*h* so that pawl pin 144*b* will engage a tooth on index wheel 138 when a pill storage compartment registers with gate 110. Also, when pawl pin 144*c* moves to engage index wheel 138, pawl pin 144*b* will move away and allow the index wheel to advance.

A link 146*b* connects pawl assembly 144 at connecting pin 144*g* to a solenoid plunger 146*a* of a solenoid assembly 146 at a plunger connecting pin 146*c*. Solenoid 146 is fastened to plate bracket 146*l* that is attached to surface 102*h*.

Looking at FIG. 7 again, gate pushbutton 112 is connected to a stem 148*a* that passes through a hole 148*b* in the top of cabinet 102. Stem 148*a* is retained by a clip 148*c* and engages a rack and pinion assembly 148 at a recess 148*d* on a rack bar 148*e*. Bar 148*e* is guided and retained by retainer guides 148*g* that are affixed to surface 102*h* by fasteners 148*h*. Rack teeth 148*f* engage a pinion 148*i* that is affixed to gate shaft 110*a*. A rack bar 148*e* engages a rack return spring 148*j* at a spring guide 148*k*. Spring 148*j* is a compression spring with sufficient force to keep gate 110 closed and pushbutton 112 raised when pushbutton 112 is not being pushed. Spring 148*j* is held by a spring retainer and rack stop 148*l* that is fastened to surface 102*h* by fasteners 148*m*. Rack bar 148*e* also engages a switch 150 that is fastened to surface 102*h* with fasteners 150*a*.

Figure 10:
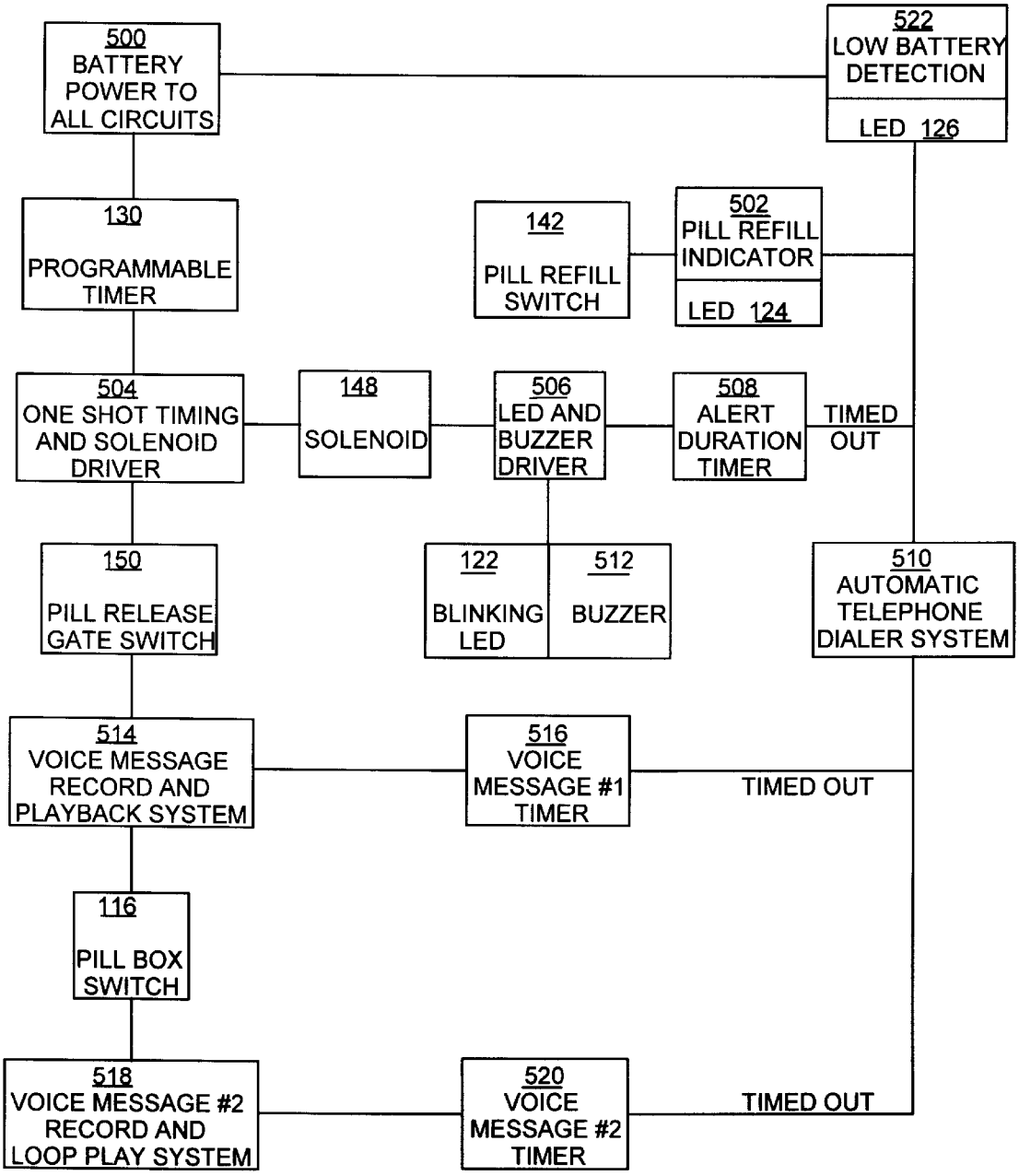
FIG. 10 is a block diagram of electronic circuitry of the dispenser of FIG. 4.

Description of Electronic Circuitry—FIG. 10

The construction of the required circuits for the enhanced embodiment is not described in detail because there are numerous ways a circuit may be designed to achieve a particular function or objective. A person proficient in the art should not have any difficulty in designing the required circuits. Only the functions, objectives, and interactions of the required circuits will be described herein. Looking at FIG. 10, a battery 500 supplies power to the entire circuitry. The voltage of battery 500 is monitored by a low battery detection circuit 522 and a low battery condition is indicated by a LED 126. A low battery condition also activates an automatic telephone dialer system 510 comprising of a wireless transmitter that turns on a nearby detached automatic telephone dialer with a voice message record and playback circuit. A pill refill switch 142 turns on a pill refill indicator circuit 502 to drive a blinking LED 124 and also activates automatic telephone dialer system 510. At the programmed preset times programmable timer 130 activates a one-shot timing and solenoid driving circuit 504 to drive solenoid 148 and simultaneously turns on a blinking LED and buzzer driver circuit 506 and an adjustable alert duration timer circuit 508. Circuit 506 drives a blinking LED 122 and a buzzer 512. Circuit 508 keeps circuit 506 on unless it is interrupted by pill gate switch 150. Circuit 508 has capability for adjustment of the length of time that the pill alert system remains turned on, and if circuit 508 is timed out, circuit 508 will activate automatic telephone dialer system 510. If the momentary gate switch 150 is actuated to turn off alert system circuit 506, it will also turn on a voice message record and playback system 514 to play a voice message #1 and activate a voice message #1 timer circuit 516. System 514 has capability to record a personal voice message and to playback the recorded message repeatedly in a loop fashion. If personal or customized voice messages are not needed, a simpler playback only system having standardized recordings of voice messages installed at the factory may be used instead. If timer circuit 516 is not interrupted by pill box switch 116 and circuit 516 is timed out, it will activate the automatic telephone dialer system 510. When pill box switch 116 is actuated, it will also turn on a voice message #2 record and loop play circuit 518 and a voice message #2 timer circuit 520. The voice message #2 record and loop play circuit 518 has capabilities similar to the circuit of system 514. Circuits of 514 and 518 preferably use integrated circuits with EEPROMs to store the voice message data in digitized form. If timer circuit 520 is not interrupted by switch 116 and is timed out, it will activate the automatic telephone dialer system 510.

Operation of the Enhanced Embodiment—FIGS. 4 through 10

Programming the Timer and Loading the Pill Storage Wheel

First, the caregiver or user needs to lay the dispenser on its back, open cabinet door 104, and set the 24-hour clock of timer 130 to the current time by adjusting knob 130*b*. Next, the caregiver or user needs to determine the preset time(s) that pill(s) will be taken, and the amount(s) and type(s) of pill(s) for each preset time. Then the caregiver or user programs timer 130 by setting tripper pin(s) 130*e* on clock dial 130*c* at the preset time(s). For example, FIG. 5 shows tripper pins set at a preset time of 7:30 AM and a preset time of 10:30 PM.

Next, the caregiver or user rewinds wheel 100 to the pill loading position by placing a finger in finger hole 100*j* and rotating wheel 100 in a clockwise direction until it can not rotate any further. The stop pin 138*d* on index wheel 138 will intercept stop pin 140*e* on block 140 and stop the rotation of wheel 100 when the finger hole 100*j* registers with gate 110. This rewinding action restores mechanical energy to spring 134 that provides torque to advance wheel 100 and obviates the need for electrical energy to rotate the pill storage wheel. Pawl pin 144*b* biased by spring 144*j* to engage a tooth on index wheel 138 except when solenoid 146 is energized, keeps the pill storage wheel from moving.

If the amount(s) and type(s) of pill(s) are the same for all the preset time(s), the loading operation is relatively simple since all pill storage compartments will receive the same amount(s) and type(s) of pill(s). However, if different amount(s) and types(s) of pill(s) are involved for more than one preset time, the loading operation is more complicated and more susceptible to error. For example, if different pills are to be taken in the morning and night and one of the pills is a sleeping pill, loading the sleeping pill in the wrong compartment may result in the pill taker sleeping during the day instead of night as intended. A pill loading indicator system is included with the dispenser to facilitate accurate loading of the pill storage wheel when different pills for different preset times are involved.

Pill Loading Indicator System

The pill loading indicator system associates the preset times arranged in sequential order with an established series of distinctive indicants; thereby each preset time is assigned a corresponding distinctive indicant. These distinctive indicants are incorporated in the use of pill loading indicator template 118 and pill loading indicator labels such as depicted by numerals 120*a,* 120*b,* and 120*c* in FIG. 5. How the pill loading indicator system works and is used are best illustrated by an example. For example, looking at FIG. 5 and assuming the dispenser will need to dispense the following pills at the following preset times each day:

| Preset Time | Quantity and Type of Pills |
|---|---|
| 7:30 AM | 1 ea. "A" pills |
| 7:30 AM | 2 ea. "B" pills |
| 10:30 PM | 1 ea. "A" pills |
| 10:30 PM | 1 ea. "C" pills |

Also assume for this example that the pill loading indicator system uses colors as distinctive indicants and has established the following series of colors as distinctive indicants for preset times arranged in sequential order with the first preset time starting after midnight:

| Designated Color | Sequential Preset Time |
|---|---|
| Green | First |
| Yellow | Second |
| Red | Third |
| White | Fourth |
| Blue | Fifth |

Obviously, the list will be longer if pills are to be dispensed more than 5 times each day, and different colors may be used instead of those listed above. Since this example only involves two preset times, the above list is more than adequate.

In using the system, the caregiver or user first writes down the preset times in sequential order and the amount(s) and type(s) of pill(s) associated with each preset time. In the present example, 7:30 AM is the first preset time and has a designated color of green as its distinctive indicant. 10:30 PM is the second preset time and has a designated color of yellow for its distinctive indicant. After adjusting the clock of timer 130 to the current time, the caregiver or user sets a green colored tripper pin at 7:30 AM and a yellow colored tripper pin at 10:30 PM in clock dial 130*c*.

Next, based on what was written down as the amount(s) and type(s) of pill(s) for each sequential preset time, the caregiver or user will put pill loading indicator labels each displaying the appropriate distinctive indicant representing the preset time and a numeral representing the quantity of pills on the pill supply containers or vials each exclusively containing one type of preselected pill. In the present example, one pill is needed from vial "A" and two pills are needed from vial "B" at 7:30 AM or the first preset time. Accordingly, the caregiver or user will take a green colored label repesenting the first preset time, and write on it "1" representing one pill, and put the completed label on the vial containing "A" pills. In a similar fashion a green label with "2" written will be placed on the vial containing "B" pills. At the second preset time or 10:30 PM, one pill is needed from vial "A" and one pill from vial "C". Hence, a yellow label with "1" written will be placed on the vial containing "A" pills; a yellow label with "1" written will be placed on the vial containing "C" pills. Numerals 120*a,* 120*b,* and 120*c* in FIG. 5 show the vials with the properly applied labels.

Next, the caregiver or user will select the appropriate pill loading indicator template. In the present example, the appropriate template is one designated for use when there are two preset times, such as shown by numeral 118 in FIG. 5. In this case, template 118 has alternating green and yellow colored sectors.

Figure 9A:
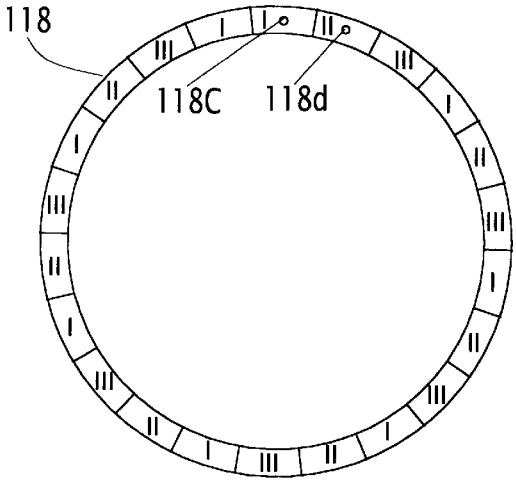
FIGS. 9A through 9D are plan views of four pill loading indicator templates for a pill storage wheel of the embodiment of FIG. 4.
Figure 9B:
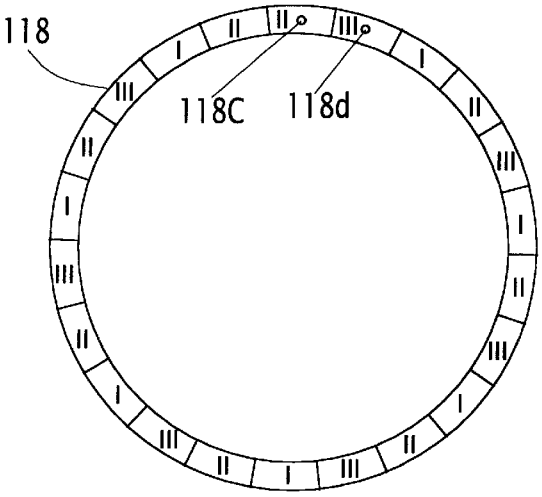
Figure 9C:
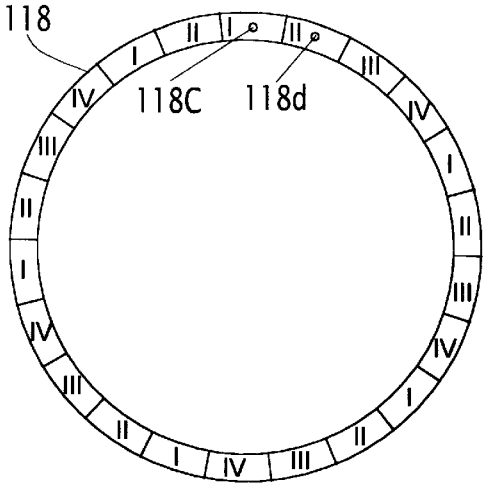
Figure 9D:
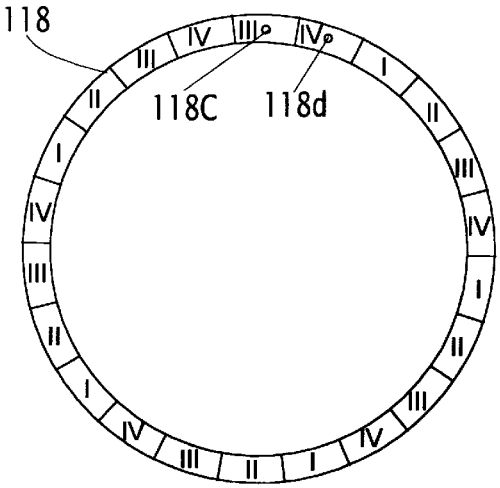

FIGS. 9A through 9D show examples of templates that are designed for use when there are series of three and four preset times each day. Two templates are used for each series of preset times because the quantity of template sectors and the quantities of preset times per series involved in these two examples necessitate two templates per series of preset times. If there are more than four preset times per day, additional templates may be similarly designed. The templates in FIGS. 9A through 9D use graphical symbols in the form of Roman Numerals as the distinctive indicants. FIGS. 9A and 9B are for three preset times per day, and FIGS. 9C and 9D are for four preset times per day. Numerals 118*c* and 118*d* are template retaining holes for aligning the appropriate sector of the template with compartment #1 of the pill storage wheel.

Wheel 100 should be fully rewound before the appropriate template is installed on the pill storage wheel. In installing template 118, the caregiver or user looks at timer 130 to determine what the approaching preset time is. Template 118 is placed on the pill storage wheel so that the distinctive indicant indicated by the template for pill storage compartment #1 (adjacent compartment clockwise from finger hole 100*g*) is the same as the distinctive indicant assigned to the approaching preset time. In the present example, the approaching preset time is 10:30 PM and the color of approaching tripper pin 120*d* is yellow. The template is secured on wheel 100 so that the template indicates yellow for compartment #1. Template 118 is secured by putting template retaining hole 118*d* that is located on a yellow colored sector of the template onto post 118*a* that is located near pill storage compartment #1. The template is also secured by template retainer 118*b*.

After the pill loading indicator template has been properly installed, the pill storage wheel is loaded with pills from the pill supply vials in accordance with the pill loading indicator labels on the vials. The caregiver or user takes vial "A" in the present example. Seeing that vial "A" has a green label with a "1", the caregiver or user puts 1 pill from vial "A" into each pill storage compartment that the pill loading indicator template indicates is green. Then seeing that vial "A" also has a yellow label with a "1", one pill from vial "A" is put into each compartment that is indicated yellow by the template. Vial "A" is then set aside and the caregiver or user takes vial "B". Seeing that vial "B" has a green label with a "2", the caregiver or user puts 2 pills from vial "B" into every compartment that is indicated green by template 118. Then vial "B" is set aside and the caregiver or user takes vial "C". Since vial "C" has a yellow label with a "1", the caregiver or user puts one pill from vial "C" into each compartment indicated yellow by the template. When the pills from vial "C" have been loaded into the pill storage wheel, there is no other pill suppy vial remaining to use and the pill loading operation is completed. The caregiver or user closes door 104 and returns the pill dispenser to an upright position at the location where it is normally placed. The pill dispenser is now ready for automatic operation.

Operation After Loading Pills

Referring to FIG. 10, when the real time clock of timer 130 reaches a preset time which has been programmed into timer 130, the timer switches on circuit 504 which delivers a single pulse of current to solenoid 146 and also turns on circuit 506 which drives blinking LED 122 and buzzer 512. Looking at FIGS. 8A through 8C, the mechanical operation of solenoid assembly 146, double ended pawl assembly 144, and index wheel 138 are shown. FIG. 8A shows the position of solenoid 146, pawl assembly 144, and index wheel 138 before the solenoid receives any current. Looking again at FIG. 6, it is seen that index wheel 138 is under torque to rotate in a clockwise direction due to the force exerted by spring 134 on drive drum 132 that is fastened to index wheel 138.

Going back to FIG. 8A, it is seen that pawl pin 144*b* is biased by spring 144*j* to intercept a tooth on index wheel 138. The tooth that is intercepted is indicated with a black dot in FIG. 8A.

Figure 8B:
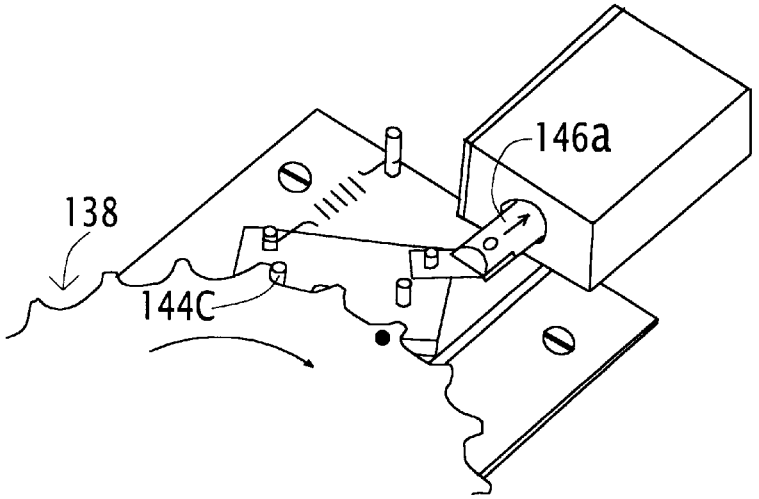

FIG. 8B shows solenoid 146 being energized and solenoid plunger 146*a* is retracting. Retracting solenoid plunger 146*a* pulls and rotates pawl bar 144*a* that is pivoted on pin 144*e* to move pawl pin 144*b* away from the intercepted tooth on index wheel 138. The force exerted by the solenoid must be sufficient to overcome the bias force of spring 144*j*, and the friction and mechanical force between the intercepted tooth and pawl pin 144*b*. As pawl pin 144*b* moves away from the intercepted tooth, pawl pin 144*c* will simultaneously move to intercept another tooth on the index wheel to limit the rotation of the index wheel.

Figure 8C:
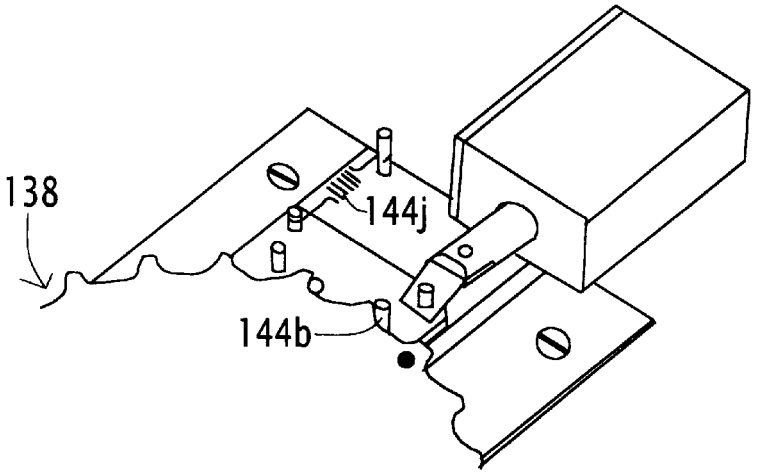

FIG. 8C shows the positions of solenoid 146, pawl assembly 144, and index wheel 138 after the electrical current driving the solenoid is turned off. As the current is going off, extension spring 144*j* returns pawl pin 144*b* to intercept another tooth on index wheel 138. The tooth intercepted will be the next tooth in a counter-clockwise direction from the tooth previously intercepted by pawl pin 144*b*. As FIG. 8C shows, the index wheel has rotated so that the tooth with the black dot has moved over one tooth position. The function of the doubled ended pawl (having pawl pins at both ends of the pawl bar) allows only one tooth of the index wheel to escape the pawl pin each time the pawl is actuated.

Since index wheel 138 and wheel 100 are both affixed to shaft 106, the rotation of the index wheel to the next successive tooth to intercept with pawl pin 144*b* will result in rotation of the pill storage wheel to the next successive pill storage compartment to register with gate 110.

As previously stated, the pill alert driver circuit 506 is also activated when solenoid 146 is energized. The pill alert circuit 506 remains activated for a set length of time controlled by timer circuit 508 unless the user turns off the pill alert circuit by pushing pushbutton 112 to actuate switch 150 that interrupts timer circuit 508 and turns off pill alert circuit 506. Timer circuit 508 may be adjusted to set the pill alert duration in accordance with the wishes of the user and the constraints of the pill administration schedule.

If pill alert circuit 506 and timer circuit 508 are not deactivated by the pill taker pushing pushbutton 112 and timer circuit 508 is timed out, timer circuit 508 will activate an automatic telephone dialer system 510 as circuit 508 is timed out. The automatic telephone dialer is programmed with telephone numbers of the off-site caregiver and other participants who have been previously informed about their role when they receive a call from the automatic telephone dialer. The automatic telephone dialer is also programmed with a recorded voice message stating that the pill taker has not responded to the programmable automatic pill dispenser as required or there is a problem with the operation of the programmable automatic pill dispenser, and assistance to investigate the problem is needed. When activated, the automatic telephone dialer will dial the programmed telephone numbers until somebody answers at a dialed number, and the automatic telephone dialer will play the recorded voice message.

If the user does not respond to the pill alert and does not push pushbutton 112, the pill(s) will not be dispensed and will remain in the pill storage wheel as a safeguard against overdose from too many pills accumulating in the pill receptacle. In addition, the caregiver or user will be able to see the pills that have not been dispensed by looking at the pill storage wheel through the transparent door 104. Thus, data on non-compliance with the pill administration schedule will be available.

If the user does respond to the pill alert issued by the dispenser and pushes pushbutton 112 to stop the blinking LED 122 and buzzer 512. Looking at FIGS. 4 and 7, the downward movement of push-button 112 operates rack and pinion assembly 148 to open gate 110. The opening of gate 110 allows pills in the pill storage compartment that is registered with the gate to fall by gravity into pill box 114. Some pills, like gelatin capsules which may stick in their container, may not fall by gravity unless the pills were placed in small non-sticking cellophane type envelopes before they were loaded into the pill storage wheel.

Using Voice Messages

The downward movement of pushbutton 112 also actuates switch 150 to activate the voice message record and playback system 514 to play a voice message #1 that was previously recorded by the caregiver or user and is stored in system 514. The message may be used to remind the pill taker of special instructions in taking the dispensed pills, or to encourage a pill taker who is not interested in taking pills to take the dispensed pills. The following is an example of a voice message #1 made by a caregiver in her personal voice for her mother: "Mom, we love you and want you to stay healthy. Please take the pill box from the machine and take your pills now with plenty of water and food." The voice message #1 will repeatedly emanate from acoustical outlet grille 128 of the pill dispenser. Timer circuit 516 will keep voice message #1 playing in a loop for a set duration, say 10 minutes, unless it is interrupted by switch 116 that is actuated by the removal of pill box 114 from the dispenser. Switch 116 serves as a detecting or sensing device for determining the emplacement of the removable pill receptacle or box in the dispenser. If the pill box is not removed and timer circuit 516 is timed out, circuit 516 will activate the automatic telephone dialer system 510 to call an off-site person to investigate the problem.

The removal of the pill box to actuate switch 116 will also turn on voice message #2 loop circuit 518. Circuit 518 contains a stored voice message that was previously recorded by the caregiver or user to remind the pill taker to replace the pill box into the machine. For example, voice message #2 may say "Please take your pills and put the pill box back in the machine so this message will stop." Timer circuit 520 will keep the voice message #2 loop going until circuit 520 is timed out or is interrupted by switch 116 which is actuated when the pill box is replaced into housing 102*b*. If circuit 520 is timed out, it will activate the automatic telephone dialer system 510 to call an off-site person to investigate the problem.

If needed, a different voice message may be provided at each preset time if the appropriate amount of voice message loop and timer circuitry is provided.

The dispenser will continue to operate in the manner described above for each successive preset time until the last pill storage compartment of wheel 100 has rotated to register with gate 110. When the last pill storage compartment registers with the gate, tripper pin 138*e* of index wheel 138 will actuate switch 142 and turn on refill indicator circuit 502 and LED 124. Switch 142 serves as a detecting device which signifies the registration of the last compartment with gate 110. In addition, Circuit 502 will activate the automatic telephone dialer system 510.

When the voltage of battery 500 deteriorates to a level that will no longer meet the power requirements of the programmable automatic pill dispenser, low battery detection circuit 522 will turn on low battery indicator LED 126, and will also activate the automatic telephone dialer system 510.

Conclusion, Ramifications, and Scope of Invention

As seen from the preceding description, the dispenser involves a simple electromechanical system that can be programmed and loaded with appropriate pills so that the proper pill(s) in the proper amount(s) will be automatically dispensed with an alert signal for the user at the proper time(s) each day. The dispenser also provides a simple system for facilitating accurate loading of pills into the dispenser, a system for providing personal voice messages to coach and instruct the pill taker into properly taking the dispensed pills and using the dispenser, and a system for alerting an off-site caregiver when dispensed pills are not taken by the pill taker or there is a problem in the operation of the dispenser. Some other advantages of the dispenser include:

a) the pill storage wheel rotates only at preset time(s) for dispensing of pill(s);

b) it has a mechanism for preventing an accumulation of dispensed pills to minimize the possibility of over-dosing;

c) it has an indicator that signifies when the pill storage wheel needs refilling; and d) it has a pill storage wheel that moves under spring power to minimize electrical energy requirement and make battery operation of the dispenser feasible.

The basic embodiment does not provide all of the above features but it is nonetheless very useful in facilitating the task of nursing home and hospital attendants in administering pills to patients. The enhanced embodiment provides all of the above features and it is very useful for people who live independently, but need assistance in complying with their pill administration schedules. Obviously, an alternative embodiment may incorporate any combination of the features.

The possible variations and ramifications of the dispenser of the present invention are numerous. For example, the methods shown for advancing the pill storage wheel in the basic embodiment and the enhanced embodiment are different; however, still another method (not shown) is the use of a rotary solenoid or rotary shaft solenoid that rotates the pill storage wheel by a fixed angular displacement each time the rotary solenoid is energized. A rotary solenoid is more complicated and more expensive than a push- or pull-type solenoid, but will obviate the need for an index wheel and pawl assembly. A servomechanism may also be used to rotate the wheel a predetermined amount each time. In another variation, the pill receptacle can be omitted. In this case, the dispenser is designed so that the user may place a hand under the pill release gate to catch the pills when the user opens the gate. A variation for detecting the removal of a dispensed pill from a dispenser is the use of an electronic motion detector or a light beam interruption device to sense the fingers of an user in retrieving the pill from a pill receptacle of the dispenser. Another ramification is the use of a solid-state programmable timer instead of the mechanical tripper type of timer shown in the drawings. Additionally, multi-color LEDs that are located in the pill storage wheel and are controlled by digital logic circuits to assign a specific color for the LED of each pill storage compartment may function as a pill loading indicator template. Other ramifications and variations of the basic concept which have not been described will be apparent to those skilled in the art. It is intended that all such ramifications and variations be included within the scope of the appended claims and their legal equivalents, and the scope of the invention not be limited by the examples given.

I claim:

1. A method of automatically dispensing a preselected pill and alerting a user to take said preselected pill at a preset time, comprising:

(a) providing a programmable timer, (b) programming said programmable timer to transmit a signal at said preset time, (c) providing a series of moveable pill storage compartments and an outlet, each compartment of said series being able to receive at least one pill and discharge said pill by gravity into said outlet when said compartment moves into registration with said outlet, (d) loading a compartment of said series with said preselected pill to provide a loaded compartment, (e) providing an actuation means for automatically moving said loaded compartment into registration with said outlet in response to said signal from said programmable timer, said actuation means including an intermittent action actuator, an index wheel, and a pawl mechanism for effecting the registration of said loaded compartment with said outlet, and (f) providing an alarm to alert said user to take the pill that is discharged, said alarm being activated when said loaded compartment moves into registration with said outlet.

2. The method of claim 1 wherein said intermittent action actuator comprises an electric-powered, linear-motion, intermittent-action actuator.

3. The method of claim 1, further including providing a pill-loading indicator system to facilitate said loading when said loading involves a plurality of preset times, a plurality of preselected pills, and different predetermined amounts of pills.

4. The method of claim 3 wherein said providing a pill-loading indicator system comprises:

(a) establishing a series of indicants sufficient in quantity to provide a different indicant for each preset time of said plurality of preset times, (b) associating each preset time of said series in sequential order with a corresponding indicant from said series of indicants, (c) assigning the moveable pill storage compartment of said series that most recently moved into registration with said outlet with an indicant from said series, said indicant being associated with the most recently transpired preset time of said series, (d) serially assigning the remaining moveable pill-storage compartments of said series with corresponding indicants from said series of indicants, (e) providing a pill-supply container which contains each preselected pill of said pluality, (f) labeling said pill-supply container to provide a labeled container having a label for each preset time when the respective predetermined amount of pills of said pill supply container will be dispensed, said label displaying the indicant associated with said preset time and a numeral equivalent to said predetermined amount of pills to be dispensed at said preset time, and (g) loading said series of moveable pill-storage compartments by transferring from each labeled container the number of pills specified on each label of said labeled container to each compartment of said series assigned the indicant similar to the indicant displayed on said each label.

5. The method of claim 1, further including providing a pill-refill indicator to alert a user to refill said series of moveable pill-storage containers with preselected pills.

6. The method of claim 5 wherein said providing a pill-refill indicator comprises:

(a) providing a counting means for detecting a predetermined quantity of loaded compartments of said series which have moved into registration with said outlet and transmitting a signal when said predetermined quantity has been detected, (b) providing an indicator means for alerting said user to refill said series of moveable pill compartments, said indicator means being activated in response to said signal from said counting means, and (c) detecting said predetermined quantity of said loaded compartments and transmitting a signal by said counting means to activate said indicator means to alert said user to refill said series of moveable pill-storage compartments with preselected pills.

7. The method of claim 1, further including providing a control for said user to govern the discharge of a pill from said outlet.

8. The method of claim 7 wherein said providing a control comprises:

(a) providing a gate means associated with said outlet for preventing the discharge of a pill through said outlet until said gate means is actuated, (b) providing an alert means for alerting said user to actuate said gate means, said alert means replacing said alarm, and (c) actuating said gate means by said user in response to said alert means to allow the discharge of said pill.

9. The method of claim 8, further including providing at least one voice message to inform said user to take said preselected pill.

10. The method of claim 9 wherein said providing at least one voice message comprises:

(a) providing a voice message record and playback system, (b) recording a voice message to inform said user to take said preselected pill on said voice message record and playback system, (c) providing a circuit means for automatically activating said voice message record and playback system to play the recorded voice message when said user actuates said gate means in response to said alert means, and (d) automatically activating said voice message record and playback system to play said recorded voice message when said user actuates said gate means in response to said alert means.

11. The method of claim 8, further including providing a remote alert when said user does not actuate said gate means within a predetermined duration after said alert means is activated.

12. The method of claim 11 wherein said remote alert is provided by:

(a) providing an automatic telephone dialer system, (b) programming said automatic telephone dialer system with a telephone number of a person other said said user who will be available to respond to an alert voice message from said automatic telephone dialer system, (c) recording said alert voice message on said automatic telephone dialer system, (d) providing a circuit means for automatically activating said automatic telephone dialer system when said predetermined duration expires and said user did not actuate said gate means, and (e) automatically activating said automatic telephone dialer system to dial the telephone number of said person and play the recorded alert voice message when said predetermined duration expires and said gate means was not actuated.

13. The method of claim 8, further including alerting a person when said user actuates said gate means but does not take the preselected pill that is discharged.

14. The method of claim 13 wherein said alerting said person is provided by:

(a) providing a removable pill receptacle at said outlet to receive the preselected pill that is discharged, (b) providing a sensing means for detecting the removal of said removable pill receptacle, (c) providing a circuit means for automatically activating said automatic telephone dialer system when said sensing means does not detect the removal of said removable pill receptacle within a predetermined time interval after said gate means has been actuated by said user in response to said alert means, and (d) automatically activating said automatic telephone dialer system to dial the telephone number of said person and play the recorded alert voice message to said person answering the telephone when said sensing means does not detect the removal of said removable pill receptacle within said predetermined time interval.

15. The method of claim 14, further including providing at least one voice message to coach said user to replace said removable pill receptacle after taking the dispensed pills from said removable pill receptacle.

16. The method of claim 15 wherein said providing at least one voice message comprises:

(a) providing a system for recording and playing back said voice message, (b) recording said voice message which instructs said user to replace said removable pill receptacle after taking the dispensed pills on said system, (c) providing a detecting means for detecting the replacement of said removable pill receptacle, (d) providing a circuit means for automatically activating said system to playback said voice message when said sensing means detects the removal of said removable pill receptacle, the playing of said voice message continuing for a preset duration unless said playing is interrupted before the expiration of said preset duration by said detecting means detecting the replacement of said removable pill receptacle, and (e) automatically activating said system to playback said voice message to instruct said user to replace said removable pill receptacle when said sensing means detects the removal of said removable pill receptacle.

17. The method of claim 16, further including providing an off-site alert when said removable pill receptacle is not replaced within said preset duration.

18. The method of claim 17 wherein said providing an off-site alert comprises:

(a) providing a circuit means for automatically activating said automatic telephone dialer system when said preset duration expires and said detecting means does not detect the replacement of said removable pill receptacle, and (b) automatically activating said automatic telephone dialer system to dial the telephone number of said person and play the recorded alert voice message to said person answering the telephone when said user does not replace said removable pill receptacle and said detecting means does not detect the replacement of said removable pill receptacle within said preset duration.

19. A method of dispensing a plurality of preselected pills in predetermined amounts over a series of preset times, comprising the steps of:

(a) providing a pill dispenser with a series of pill-storage compartments to correspond with said series of preset times, each pill-storage compartment being able to receive a plurality of pills to be dispensed and dispense said pills at said series of preset times, respectively, (b) establishing a series of indicants sufficient in quantity to provide a different indicant for each preset time of said series of preset times, (c) associating each preset time of said series in sequential order with a corresponding indicant from said series of indicants, (d) assigning each pill-storage compartment of said series with the corresponding indicant from said series, (e) providing a pill-supply container which contains a supply of each preselected pill of said pluality, (f) labeling said pill-supply container to provide a labeled container with a label for each preset time when the respective predetermined amount of pills of said pill-supply container will be dispensed, said label displaying the indicant associated with said preset time and a numeral equivalent to said predetermined amount of pills to be dispensed at said preset time, (g) loading said series of pill-storage compartments by transferring from each labeled container the number of pills specified on each label of said labeled container to each compartment of said series assigned the indicant similar to the indicant displayed on said each label, and (h) dispensing at each preset time of said series the contents of the corresponding pill-storage compartment of said series.

20. The method of claim 19 wherein said series of indicants comprises a series of different colors.

21. The method of claim 19 wherein said series of indicants comprises a series of different graphic symbols.

22. A programmable automatic pill dispenser, comprising:

(a) a cabinet having a rotatable pill-storage wheel and a pill outlet, (b) said rotatable pill-storage wheel having a series of pill-storage compartments disposed concentrically about the center axis of said pill-storage wheel, (c) each pill-storage compartment of said series arranged to receive at least one pill and discharge said pill by gravity via said pill outlet, (d) said pill outlet positioned to discharge said pill by gravity from said pill-storage compartment when said pill-storage compartment moves into registration with said pill outlet, (e) an actuation means for rotating incrementally said pill-storage wheel to move a loaded pill-storage compartment proximal to said pill outlet into registration with said pill outlet when said actuation means is activated, said actuation means comprising an index wheel, an intermittent action actuator, and a pawl mechanism, and (f) a programmable timing means for programming preset times for dispensing preselected pills and enabling the activation of said actuation means at each programmed preset time.

23. The dispenser of claim 22, further including a refill indicator device for detecting and warning when to refill said compartments of said pill-storage wheel with preselected pills, said refill indicator device comprising:

(a) a detecting means for detecting when a predetermined quantity of said compartments have moved into registration with said pill outlet and transmitting a signal when this occurs, and (b) an indicator means for alerting a user of the need to refill said compartments when said detecting means transmits said signal.

24. The dispenser of claim 22, further including a pill-loading indicator system means for facilitating accurate loading of pills into said series of pill-storage compartments by associating said each programmed preset time in sequential order with a corresponding indicant from an established series of indicants and identifying the preselected pills to be dispensed at said each programmed preset time and respective pill-storage compartments of said series to be loaded with said preselected pills with the corresponding indicant, said pill-loading indicator system means comprising:

(a) a plurality of labels each displaying the corresponding indicant from said series to represent the programmed preset time and displaying a numeral to represent the quantity of a pill type to be dispensed at said programmed preset time for respectively labeling one or more supply containers, each containing one type of pill, and (b) a pill-loading indicator template displaying one or more said corresponding indicants from said series for association with said respective pill-storage compartments.

25. The dispenser of claim 22, further including a pill-release gate associated with said pill outlet for keeping the pill in said loaded pill-storage compartment that has moved into registration with said pill outlet until a user of said dispenser actuates said pill-release gate to discharge said pill by gravity through said pill outlet.

26. The dispenser of claim 24, further including a signal means for alerting said user to actuate said pill-release gate to discharge said pill, said signal means being activated for a predetermined time interval or until said user actuates said pill-release gate before the expiration of said predetermined time interval.

27. The dispenser of claim 26, further including a voice message means for providing information to said user to consume the dispensed pills, said voice message means comprising a voice message record and playback system with a recorded voice message providing said information and said system being activated to playback said recorded voice message for a predetermined time interval when said user actuates said pill release gate in response to said signal means.

28. The dispenser of claim 26, further including a voice message means for providing information to the user on using the dispenser and on consuming the dispensed pills, said voice message means comprising a playback only voice message system having a recording providing said information and said system being activated to playback said recording for a predetermined time interval when said user actuates said pill-release gate in response to said signal means.

29. The dispenser of claim 26, further including a remote alert means for alerting a person other than said user that said user has not responded to said signal means by actuating said pill-release gate before the expiration of said predetermined time interval, and said remote alert means including an automatic telephone dialer system capable of automatically dialing a programmed telephone number to reach said person and playback a recorded alert voice message for said person.

30. The dispenser of claim 29, further including a remote alert device for alerting said person when said user actuates said pill-release gate device in response to the alert from said signal means, but does not take the discharged pill within a predetermined time interval.

31. The dispenser of claim 30 wherein said remote alert device comprises:

(a) a removable pill receptacle associated with said pill outlet, (b) a sensing means for detecting the removal of said removable pill receptacle, and (c) a circuit means for automatically activating said automatic telephone dialer system when said sensing means does not detect the removal of said removable pill receptacle within said predetermined time interval after said pill-release gate has been actuated by said user in response to said signal means, whereby providing a telephonic alert voice message to said person when said user did remove said removable pill receptacle to take the dispensed pills.

32. The dispenser of claim 22 wherein said intermittent action actuator comprises an electric-powered linear motion intermittent action actuator.

33. The dispenser of claim 22 wherein said actuation means further comprises:

(a) said index wheel associating with said pill storage wheel, (b) said index wheel having circumferential teeth angularly displaced in correspondence with said pill storage compartments of said pill storage wheel, (c) an articulated pawl mechanism engaging said index wheel, said intermittent action actuator being arranged to actuate said articulated pawl mechanism when said actuation means is activated, and (d) a detent mechanism means for arresting rotation of said index wheel so that a pill storage compartment of said pill storage wheel remains in registration with said outlet means when said articulated pawl mechanism is not being actuated.

34. The dispenser of claim 22 wherein said actuation means further comprises:

(a) a spring assembly means for applying rotational torque to said index wheel, (b) said index wheel associating with said pill storage wheel, (c) said index wheel having circumferential teeth angularly displaced in correspondence with said pill storage compartments of said pill storage wheel, and (d) a double-ended pawl mechanism engaging said index wheel so that a pill storage compartment of said pill storage wheel remains in registration with said pill outlet when said double ended pawl is not being actuated, said intermittent action actuator actuating said double-ended pawl mechanism when said actuation means is activated.

* * * * *